US006314599B1

(12) United States Patent
Hay

(10) Patent No.: US 6,314,599 B1
(45) Date of Patent: Nov. 13, 2001

(54) FASTENER PULLING TOOL

(76) Inventor: Patrick James Hay, R. R. #1, Pipestone, Manitoba (CA), R0M 1T0

( * ) Notice: Subject to any disclaimer, the term of this patent is extended or adjusted under 35 U.S.C. 154(b) by 0 days.

(21) Appl. No.: 09/370,223

(22) Filed: Aug. 9, 1999

(30) Foreign Application Priority Data

Aug. 25, 1998 (CA) ..... 2245608

(51) Int. Cl.[7] ..... B25F 1/00
(52) U.S. Cl. ..... 7/117; 7/137; 254/28
(58) Field of Search ..... 7/117, 125, 137; 254/22, 28; 140/123

(56) References Cited

U.S. PATENT DOCUMENTS

| | | | | |
|---|---|---|---|---|
| 24,464 | * | 6/1859 | Jeffery | 7/137 |
| 302,229 | * | 7/1884 | Beazley | 7/117 |
| 650,186 | * | 5/1900 | Maxson et al. | 254/28 |
| 871,476 | * | 11/1907 | Chaney | 254/28 |
| 1,495,028 | * | 5/1924 | Mitchell | 7/117 |
| 1,946,742 | | 2/1934 | Hingst . | |
| 1,949,335 | | 2/1934 | Settles . | |
| 1,991,778 | | 2/1935 | Taylor . | |
| 2,351,703 | | 6/1944 | Peterson . | |
| 2,462,250 | | 2/1949 | Andrews . | |
| 2,577,911 | | 12/1951 | Palmer . | |
| 3,241,814 | | 3/1966 | Forte . | |
| 5,035,400 | | 7/1991 | Altenback, Jr. . | |
| 5,303,748 | | 4/1994 | Haldemann . | |
| 5,586,584 | | 12/1996 | Haldemann . | |

* cited by examiner

*Primary Examiner*—Lowell A. Larson

(57) ABSTRACT

A staple pulling plier of the type consisting of a pair of pivoting members having handles and jaws forming a head portion. The head portion has opposite side faces, and the jaws in a closed position define a substantially continuous post engaging top ridge. Pincer points are provided on the jaws adjacent the top ridge and are moved to a closed staple grasping position on closure of the handles. A fulcrum member is formed integrally with the head portion and projects from one of the opposite side faces of the head portion, the fulcrum member defining an upper edge extending in a plane substantially normal to the post engaging top ridge of the jaws. When the bight of a staple is held by the pincer points, the two legs of the staple and the joining bight are in a plane normal to the post engaging top edge of the head portion. When the staple has been driven into a post to secure a horizontal strand of the fence, its plane is usually vertically disposed. Thus, as the plier is swung in a direction coinciding with the plane of the staple, the upper edge of the fulcrum member engages the post, and pressure can be applied in an up or down direction to more effectively withdraw the staple.

4 Claims, 14 Drawing Sheets

FASTENER PULLING TOOL

FIELD OF THE INVENTION

This invention relates to a fastener pulling tool such as a plier used in fencing operations including fence repairs when it is necessary to loosen or remove staples, nails and the like from posts.

BACKGROUND TECHNOLOGY

Various tools are used in building, repairing or removing fencing. A common form of fencing which has been in use for many years consists of barbed wire and/or page wire fencing which is stretched tightly and fastened to wooden posts by way of metal staples driven into the post. Without a proper tool, it is difficult to remove the staple once it has been driven tightly against a strand of wire making up the fence. The most common tool presently sold is designed for various uses in fencing, and this tool, which is designed for removing staples, is a more modern version of the tool shown in U.S. Pat. No. 1,949,335, Feb. 27, 1934 to Settles. While variations of this tool are still being developed, see for example U.S. Pat. No. 5,303,748, Apr. 19, 1994 and U.S. Pat. No. 5,586,586, Dec. 24, 1996, both of Haldemann, the design of the most commonly accepted fencing tool has remained substantially unchanged for a long period of time.

The above described tool which has been most readily available has certain deficiencies with regard to the use it is most commonly put, i.e., that of pulling staples. In many cases the fence post is a section of a trunk of a small tree, such as a cedar tree and is of a substantially circular cross-section. In some instances the post may be of relatively small diameter. In driving the staple horizontally into the post to capture a stretched strand of fencing wire, the staple is oriented so that it is in a vertical plane. Thus, using as an example FIG. 5 of the above-identified U.S. Pat. No. 1,949,335, when the tool is clamped onto a staple, as illustrated, the tool must be swung in a direction which is normal to that of the staple, i.e. in a horizontal plane. This results in the curved tail portion of the tool which provides a moving fulcrum for the outward prying of the staple, moving about the outer circumference of the post, thereby continuously reducing the outward pull on the staple and actually progressively pulling the staple sideways. This usually results in the bending of the staple, and when the post is of small diameter, it may become necessary to attempt to finish the pull by exerting a pull straight outward and without the advantage of leverage. Alternatively, to finish the pull of the staple the plier may be moved to another prying position.

Also, one frequent reason for removing the staples to release the fencing wires from the post is that the post has been broken, usually at or slightly above ground level. In this situation, it becomes virtually impossible to exert any withdraw force on the staple by turning the plier in a horizontal plane because this simply causes the post to effectively twist about its own longitudinal axis.

There is available on the market another fencing plier which has cut out portions in the jaws so as to provide separated pincer portions for straddling the staple and being disposed to grasp the wire being held by the staple at either side of the staple. The purpose of the design is obviously to allow a pull to be exerted by swinging the plier in a direction coinciding with the plane of the staple, as is done with the present invention. Another form of a plier which is designed to achieve the same result is shown in U.S. Pat. No. 2,577,911, Dec. 11, 1951, to R. A. E. Palmer. However, the principle of attempting to remove a staple by pulling on the wire being held by the staple is not usually practical. When a staple has been driven tightly into the post, the horizontal strand of wire being held thereby is usually buried in the post under the bight of the staple, thus making it extremely difficult to force the pincer points behind the wire to achieve any pull on the wire. Moreover, if the staple is held firmly by the post, which is the usual situation, the wire will deform and will possibly break before the staple is released. Once the wire breaks, further work must be done to remove the staple. When the tool is being used in the repair of fences, the breaking of the wire can result in considerable additional repair work, and even a significant bend in the wire can result in future breaking of the wire.

Moreover, while the most commonly sold fencing plier includes a hammer face at one side edge, it is the experience of most users that effective and straight driving of a staple or nail is not easily achieved. The ineffective use of such hammer face seems to be because of the orientation of the tool as held when using the hammer face or the lack of momentum which can be achieved due to the weight or distribution of weight in the head of such a plier when striking a staple or nail with the hammer face. Also, while such fencing pliers are usually provided with a pointed outer end of the tail portion making up the moving fulcrum, which pointed outer end can be also used, for example, in wedging out a tightly driven staple, many such pliers have no useful part for removing nails. Nails are frequently encountered because they may be used in attaching insulators to the posts for stretching electric fencing. Also, spikes which might be used in fencing for attaching bracing poles and the like.

SUMMARY OF THE INVENTION

Accordingly, it is one object of the present invention to provide a tool, more generally referred to hereinafter as a plier, of a simple structure which permits the removal of a fastener, such as a staple by exerting an effective pulling force on the fastener.

It is an object of one form of the invention to provide in the fencing plier an effective hammer portion and to further form the structure utilized in the removal of staples to also function as a nail pulling claw.

According to one form of the present invention there is provided a plier for pulling staples from posts and the like, the plier being of the type having a pair of members connected in scissor-fashion for pivotal operating action in a plane normal to pivot axis of the members. Each member includes a jaw and a handle portion and wherein the jaws of the pair of members form a head portion on a side of the pivot axis opposite to the handle portions, the head portion having opposed side faces formed by the jaws and disposed in substantially parallel planes normal to the axis. The jaws in a closed position define a substantially continuous post engaging top edge or ridge, and the jaws have opposed surfaces which may define staple grasping pincer points and are adjacent the top edge and move toward engagement on closure of the handles. The plier includes a fulcrum means formed integrally with the head portion and projecting laterally from one of the opposite side faces, the fulcrum means defining a post engaging surface extending in a plane substantially normal to the post engaging ridge defined by said jaws and providing a leverage for pull on a grasped staple upon swinging said handle portions normal to the post engaging ridge and in a direction towards the side from which the fulcrum means projects.

When the staple has been driven into a post to secure a horizontal strand of the fence, its plane, i.e., the plane containing the bight of the staple and the two legs joined thereby, is substantially vertically disposed. It can be appreciated, therefore, that with the present invention, as the bight of the staple is grasped by the pincer points and the plier is swung in a direction coinciding with the plane of the staple, the upper edge of the fulcrum means engages the post and the pressure can be applied in an upward or downward direction, rather than around the post, to more effectively withdraw the staple. Also, in the present invention the withdrawing force is applied directly to the bight of the staple rather than to the fencing wire.

In a preferred embodiment of the invention, the fulcrum means includes a pair of parallel fulcrum members one each being integrally formed with one of the jaws on a common side face of the head portion. More specifically the pair of fulcrum members together are of a hammer-claw configuration having inner side edges defining a nail grasping opening therebetween when the plier is in a closed condition.

In one specific embodiment of the invention, a hammer head is integrally formed with one of the jaws and projects outwardly from the side face of the head portion which is opposite to the side face of the head portion from which the fulcrum means projects.

BRIEF DESCRIPTION OF THE DRAWINGS

In the accompanying drawings there are shown a plurality of embodiments as examples of the present invention, and wherein.

DESCRIPTION OF A PREFERRED EMBODIMENT OF THE INVENTION

Figure 1:
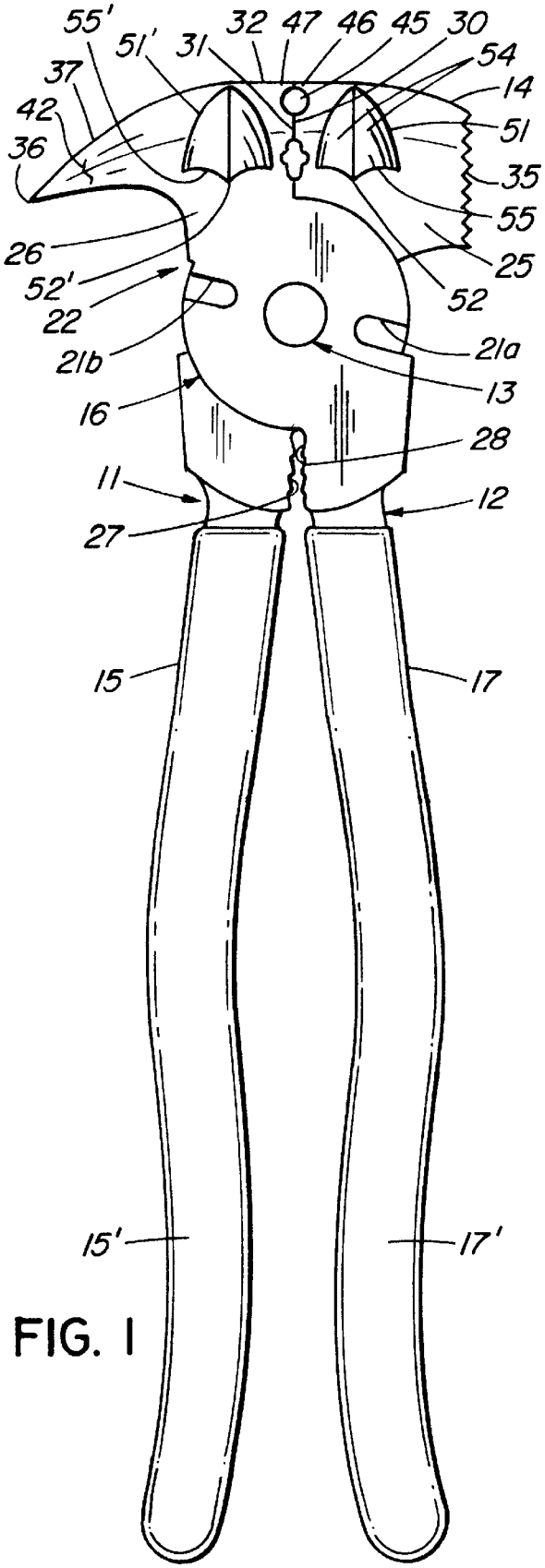
FIG. 1 is a view of one face, hereinafter referred to as the rear or back face, of one embodiment of the tool of the present invention, particularly for use in fencing work.

In the drawings, reference numbers denoting parts of the structure correspond to the reference numbers used herein to describe like parts, and reference number 10 generally denotes one embodiment of the present invention in the form of a fencing plier. As is common to the design of fencing pliers, the tool 10, hereinafter referred to as a plier, consists of two elongated members 11 and 12 connected together in a scissor fashion by way of a pivot means 13 which is closer to the upper end of the fencing plier. It should be appreciated that while the plier is generally used in any orientation, for the sake of convenience, reference is made to the jaw or head end of the plier, as is shown in FIG. 1, as being the upper end of the fencing plier 10.

The elongated member 11 is normally formed as an integral unit, such as by casting, and includes a jaw portion 14 and a handle portion 15, and similarly the elongated member 12 includes a jaw portion 16 and a handle portion 17 formed integrally with the jaw portion 16. The pivot means 13 may be a pin member formed separately of either of the elongated members 11 and 12, or alternatively, it could be in the form of a cylindrically shaped stub post integrally formed with one of the elongated members and rotatably received in a circular opening in the other member.

The elongated handle portions 15, 17, which terminate at a lower handle end of the plier, are preferably shaped to provide slightly curved hand engaging areas 15' and 17'. The handle portions 15 and 17 are customarily covered with a soft insulating material, such as plastic. The distance of the hand engaging area 15' and 17' from the pivot means 13 is considerably greater than the distance of the operating portions of the jaws from the pivot means in order to provide the required leverage for tight gripping by the jaws. As is also well known in fencing plier designs, the elongated member 11 is provided with sharp edged slots 20*a*, 20*b* which are radially disposed relative to the center of the pivot means 13, and elongated member 12 is provided with like slots 21*a*, 21*b* which aligns with slots 20*a*, 20*b* when the handle portions 15 and 17 are partially separated to an opened position. Aligned slots 20*a*, 21*a* and 20*b*, 21*b* of the two elongated members 11 and 12 provide an opening for receiving a fencing wire when the handles are partially opened, whereby on closure of the handle portions 15 and 17, a wire disposed in the slots may be severed by the scissor action between the edges of the slots.

The jaw portions 14 and 16 together form what might be overall termed a head portion 22 in the area of the pivot means 13. In the head portion 22, a front flat face of the jaw portion 14 of member 11, hereinafter referred to as the front face 23 of the head portion (FIG. 4), is in the same plane as a flat front face of the jaw portion 16 of member 12, hereinafter referred to as the front face 24, and a flat face of jaw portion 14, hereinafter referred to as the back face 25 (FIG. 1), is in the same plane as the back flat face of the jaw portion 16, hereinafter referred to as the back face 26. Thus, the head portion 22 has overall front and back surfaces which are flat and parallel to each other.

The jaw portions 14 and 16 have on the handle side of the pivot means 13 opposed inner surfaces 27 and 28 which move towards each other as the handle portions are closed, but remain slightly separated even when the handle portions are closed to their maximum. The surfaces 27 and 28 are serrated and are used for gripping fencing wire when the wire is being tightened as is well known in the art.

Figure 3:
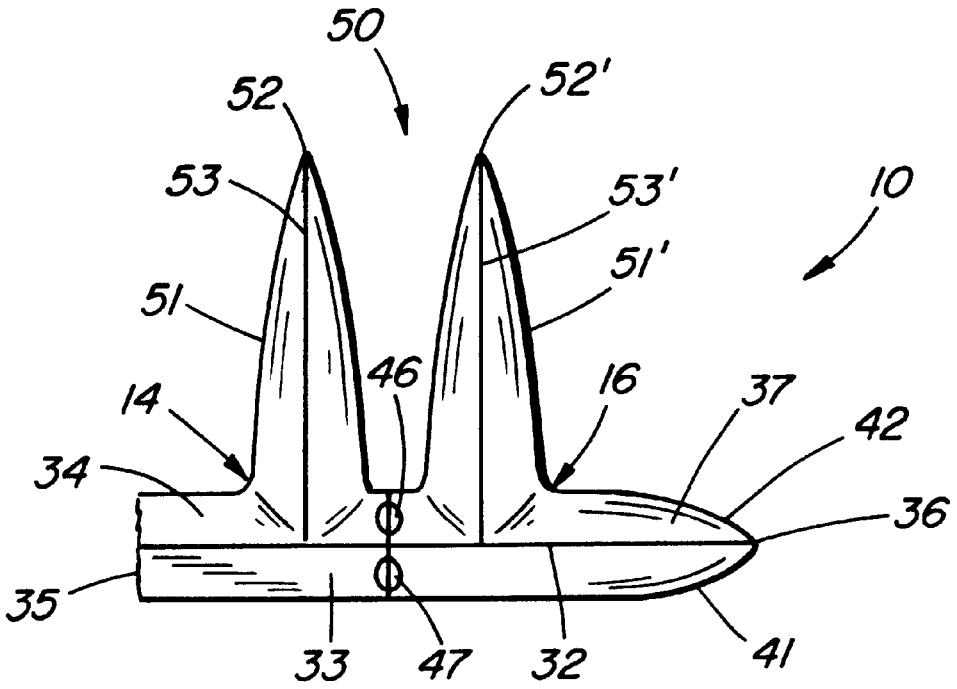
FIG. 3 is a top end view of the tool of FIG. 1.

Above the pivot means 13, the jaw portions have opposed inner side surfaces 30 and 31 which move to engage in a closed position as the handle portions 16, 17 are completely closed. When closed, a continuous top ridge 32 of the head portion 22 is formed by the uppermost portion of the two jaw portions 14 and 16. As is most apparent from FIGS. 3 and 5, the coplanar front and back surfaces of the two jaw portions converge inwardly and upwardly at the top, as shown at 33 and 34, to form the top ridge 32.

The top ridge 32 terminates at one side of the head portion 22 in a hammer surface 35 formed at the outer side of jaw portion 14. The hammer surface may be used for driving staples. At the other side of the head portion, the jaw 16 terminates in a point 36 of a tail portion 37. The tail portion 37 is preferably curved slightly and hooked downwardly, and the sides 40 and 41 thereof converges inwardly to provide the point 36 at the outer end of the tail portion 37. Thus, the top ridge 32 of the head portion 22 curves downwardly from the inner side surface 31 of jaw portion 16 to the point 42 . Also, there is preferably a slight curvature of the top ridge 32 from the inner side surface 30 of the jaw portion 14 downwardly to the hammer surface 35 giving a slight overall curvature along the full length of the ridge 32.

Formed immediately below the top ridge 32, and in the inner surfaces 31 and 32 of the jaw portions 14 and 16, there are opposed, substantially semi-circular transverse grooves 43 and 44, which together form a substantially circular transverse opening 45 when the plier are completely closed. The circular transverse opening 45 together with the converging surfaces 33 and 34 which form the top ridge 32 provide opposed pincer points 46 and 47 of jaw portions 14 and 16, respectively, immediately blow the top ridge 32.

Figure 2:
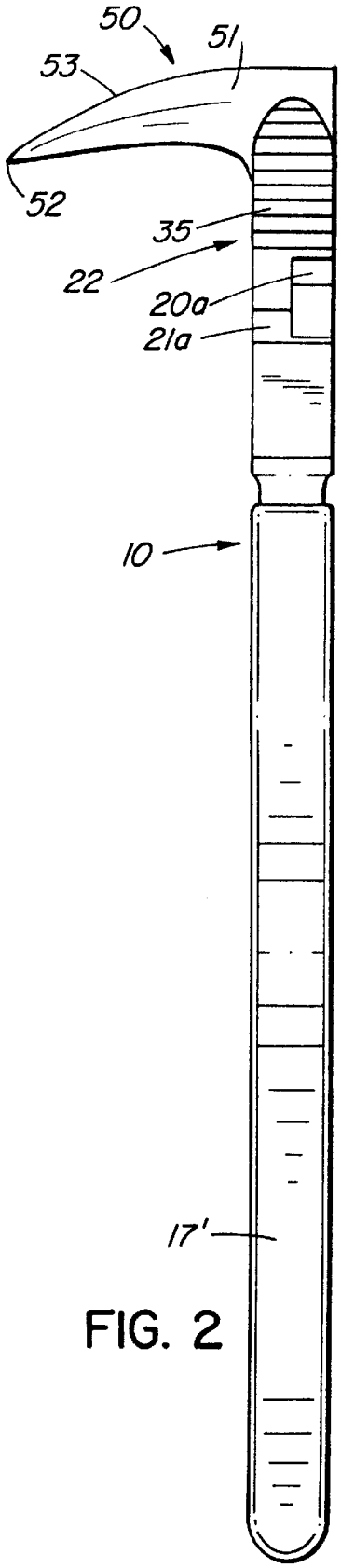
FIG. 2 is a view of one edge or side of the tool of FIG. 1.
Figure 5:
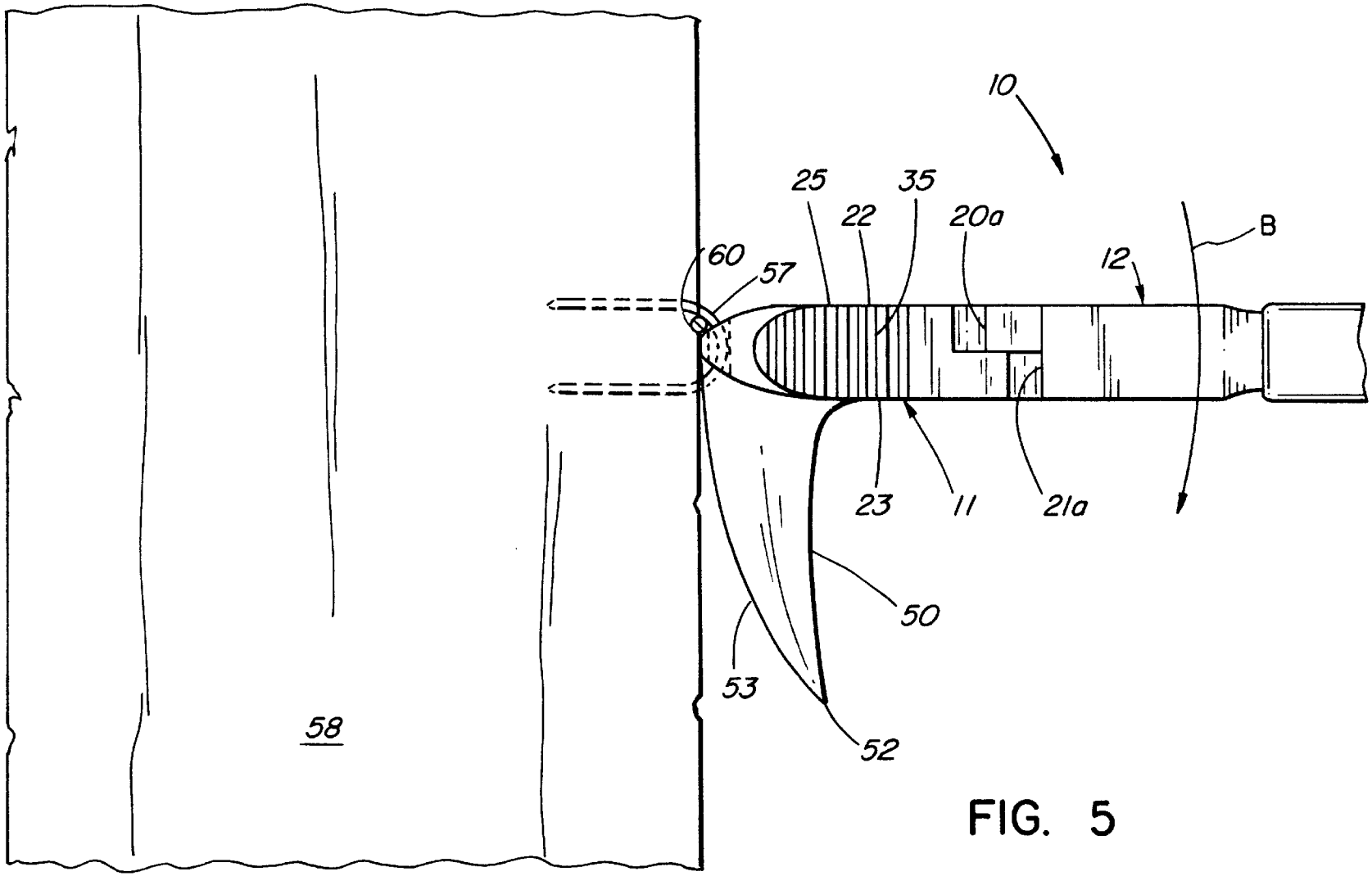
FIG. 5 is a view as seen from one side of the tool, and like FIG. 4, shows the tool in a staple grasping condition.
Figure 6:
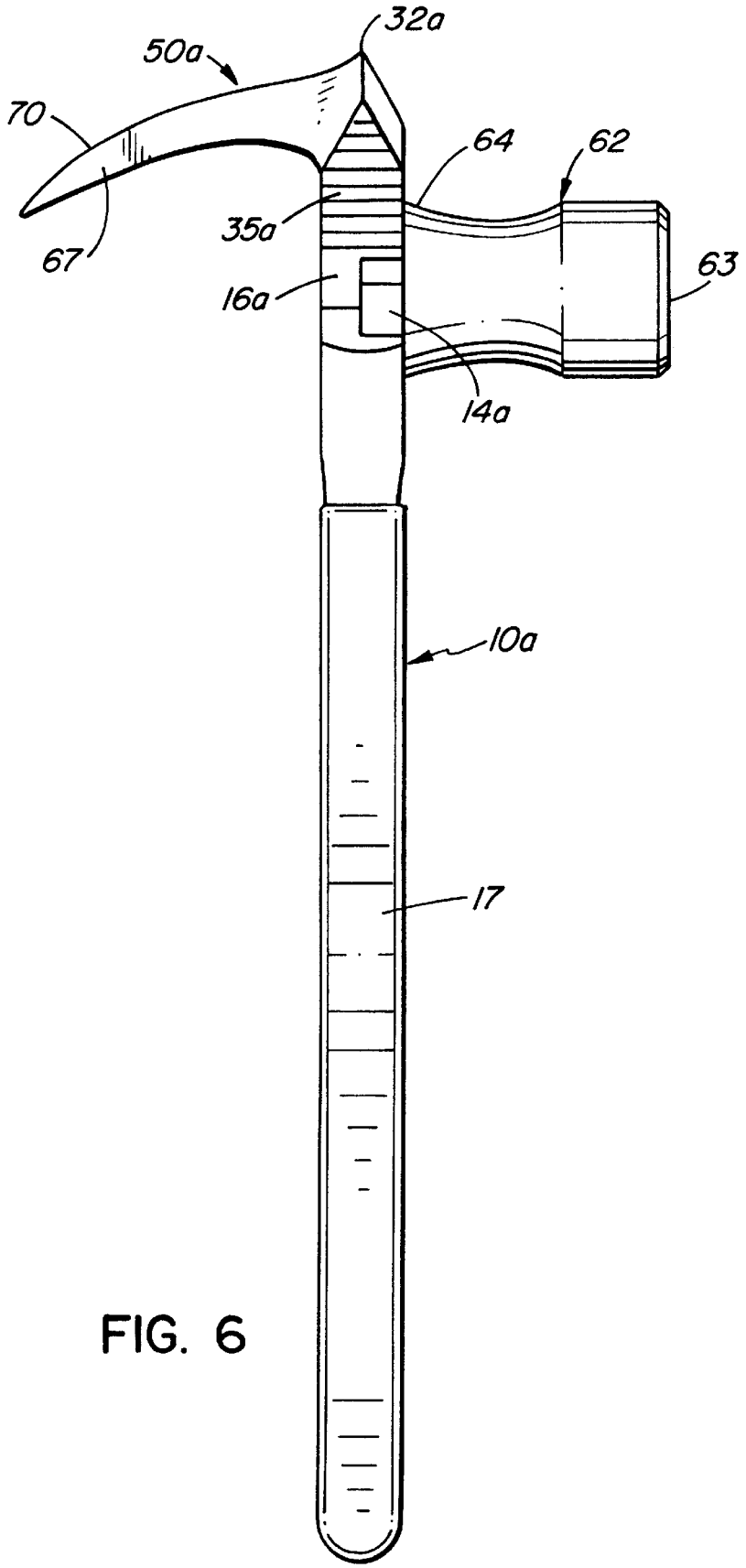
FIG. 6 is a side view corresponding to FIG. 2, but of a second embodiment of a tool of the present invention.
Figure 7:
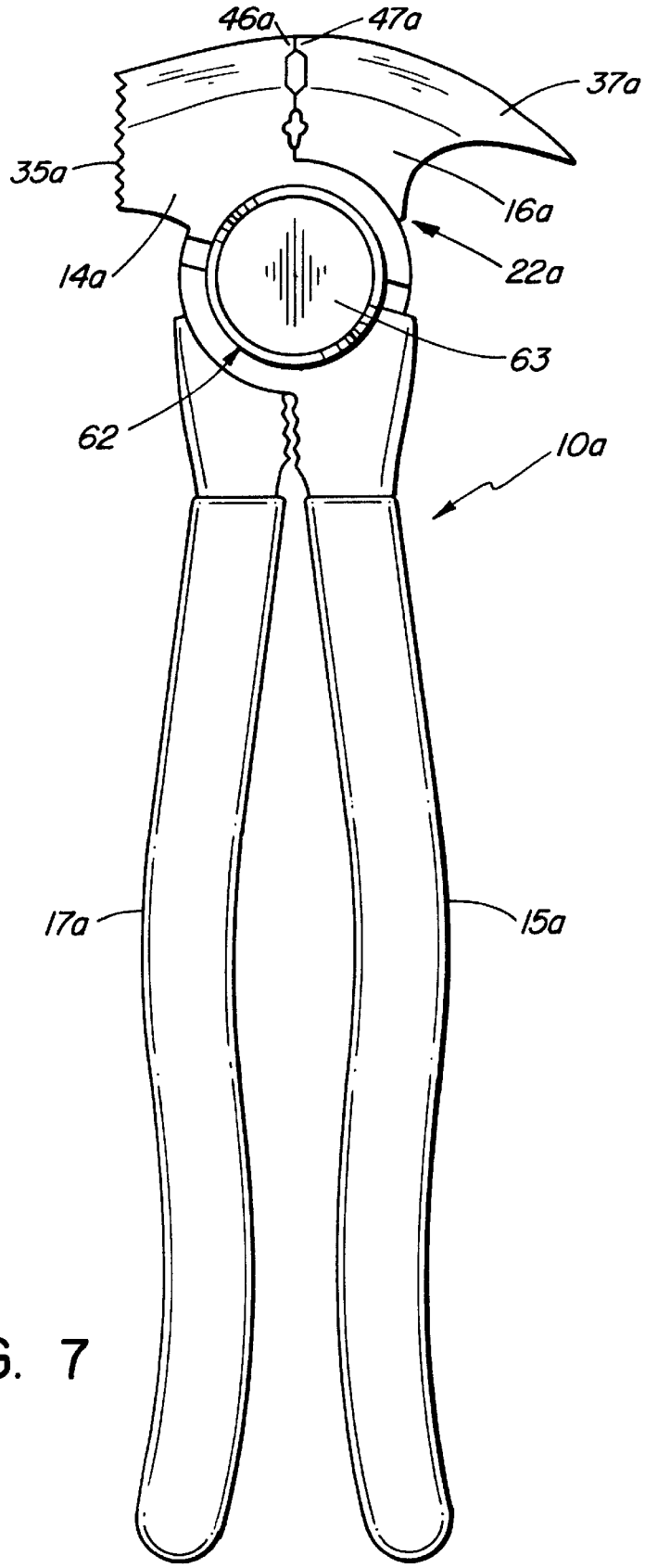
FIG. 7 is a view of a front face, opposite to that of FIG. 1, but of the embodiment shown in FIG. 6.
Figure 8:
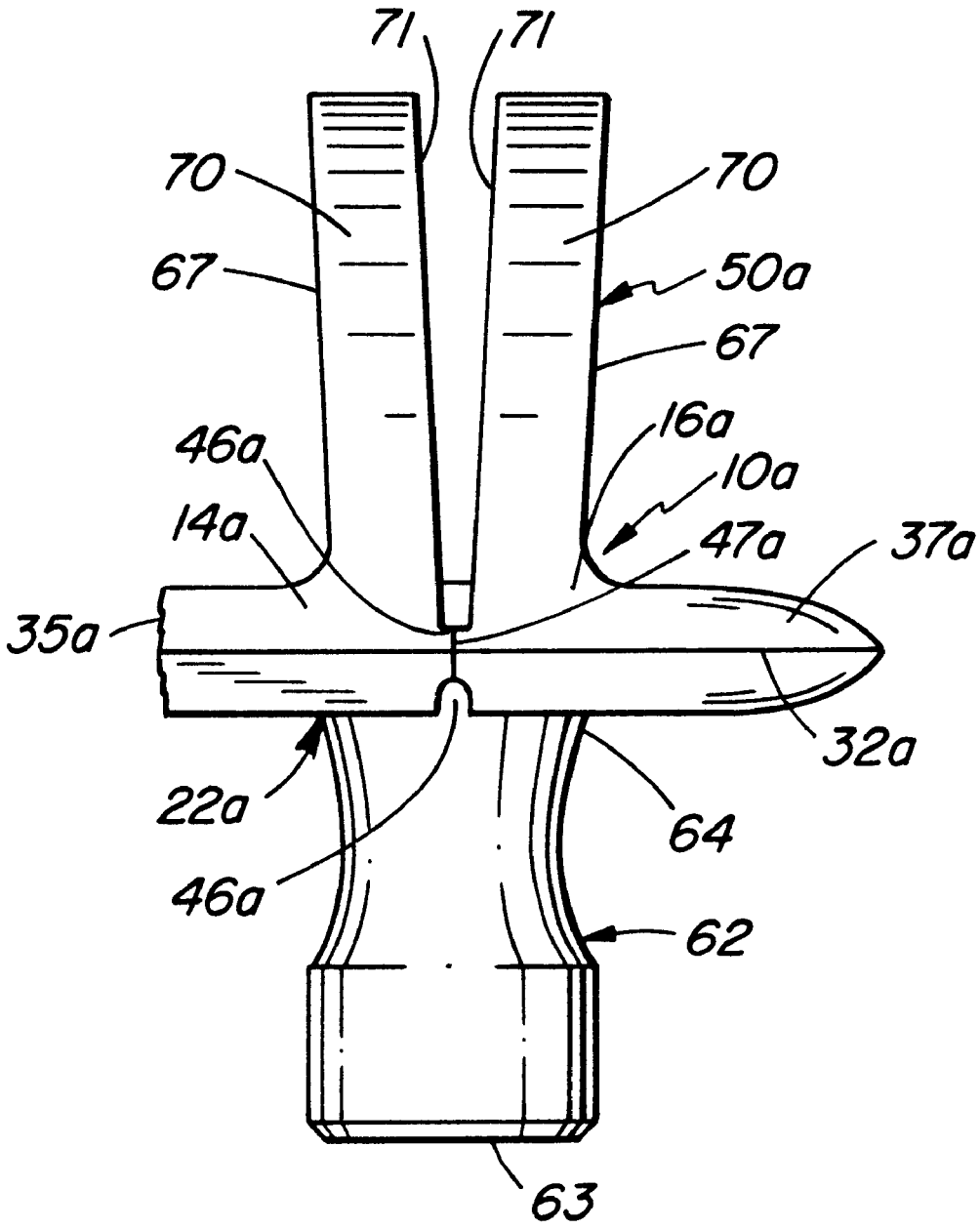
FIG. 8 is a top end view corresponding to FIG. 3 but again of the second embodiment of the fencing tool according to the present invention.
Figure 9:
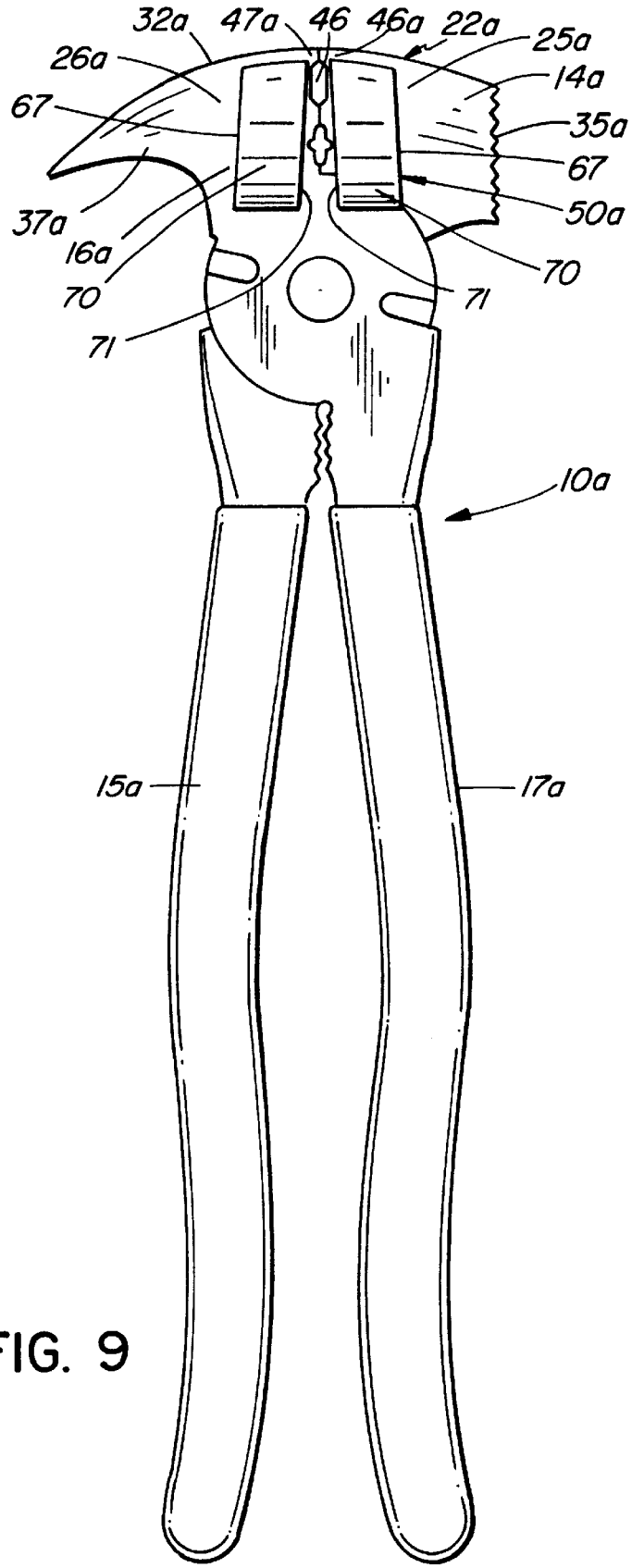
FIG. 9 is a view of a front face, which is opposite to that of FIG. 7, of the second embodiment of the fencing tool of the present invention.

Projecting from the rear faces 25, 26 of the jaw portions 14,16 there is provided a lateral protuberance 50 forming a fulcrum means projecting laterally from the rear face of the jaw portion 14. While this laterally projecting protuberance or fulcrum means 50 may be a single element formed integrally with either of the jaw portions 14 and 16, it is shown in the present embodiment in the form of two spaced tail portions 51 and 51', one each formed integral with the jaw portions 14, 16, respectively, and extending substantially perpendicularly from the back faces 25 and 26 thereof. In this embodiment, the laterally projecting tail portions 51, 51' have a shape similar to that of the tail portion 37 previously described. The tops of each tail portion 51,51', which are defined by top ridges 53, 53', respectively, merge at there inner ends substantially with or slightly below the top ridge 32 of the head portion 32. The top ridges 53,53', which extend in parallel vertical planes relative to each other are provided with a slight downward curvature along their length and terminate in outer points 52,52' as best seen in FIGS. 2 and 5. Each of the tail portions 51, 51' have side surfaces 54, 54' which curve upwardly and inwardly towards the ridges 53, 53', and the side surfaces also converge towards the outer points 52, 52'. Each of the tail portions 51, 51' have a relatively flat, slightly downwardly curved bottom surface 55, 55', respectively.

As indicated instead of providing a pair of the tail portions 51, 51', as shown, the laterally projecting protuberance 50 would function with only one tail portion disposed on either of the back faces 25 and 26 of the jaw portions 14 and 16. However, better balance in extracting staples, as will be described in more detail below, is obtained with the two tail portions 51, 51' as shown, disposed equal distance from the pincer points 46,47. Moreover, it would be possible to provide two laterally projecting protuberances, one on the back face of the head portion 22 and one on the front face of the head portion 22.

Figure 4:
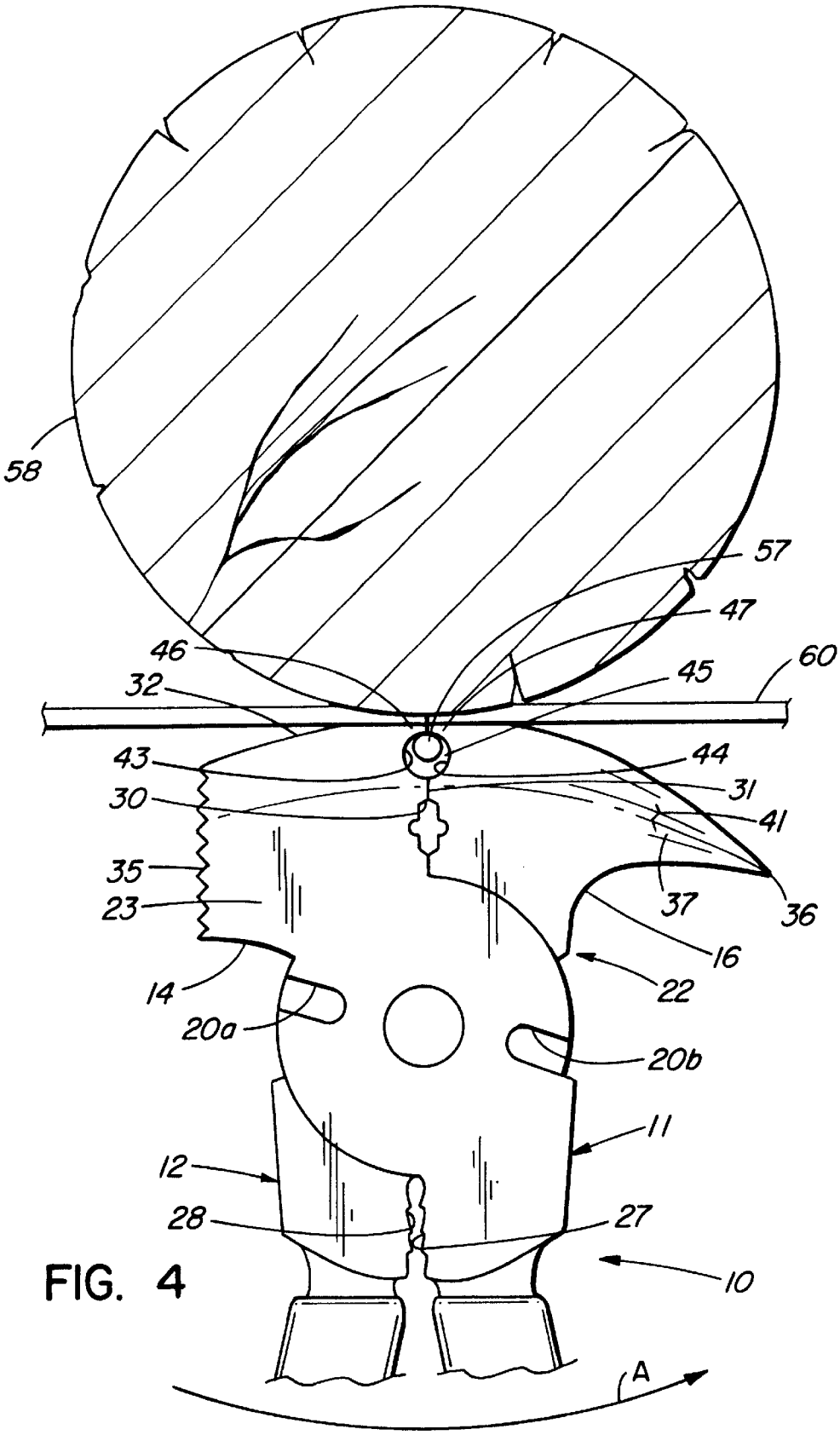
FIG. 4 is an enlarged view looking down on a face of the head portion of the tool opposite to the face as shown in FIG. 1, and showing the tool in a staple grasping condition.

As has been indicated above, the illustrated fencing plier 10 includes design features to allow use for usual fencing functions, including grasping and tensioning wire to some degree, cutting wire and hammering staples and/or nails. The fencing plier offer superior operation, however, in removing staples, such as shown at 57, which have been driven into a post 58 to secure a horizontal strand of fencing as shown at 60 (FIGS. 4 and 5). In order to pull the staple the plier are opened a small amount and the pincer points 46,47 are placed on either side of the bight portion of the staple. The plane of the staple, i.e., the plane which contains the two legs of the staple and the bight portion which connects the two legs, is disposed in a generally vertical plane in order to embrace the strand 60 which extends horizontally. As the handle portion 15, 17 are squeezed together, the pincer points 46, 47 come together under the bight of the staple 57 so that the bight of the staple is enclosed within the transverse opening 45 in the head portion 22 of the plier.

It might first be explained that as seen in the top view of the plier, as shown in FIG. 4, the staple 57 is thus grasped by the pincer points 46, 47 as would be done with conventional fencing plier. In order to remove the staple with a conventional plier, the plier is swung in a substantially horizontal plane in the direction indicated by arrow A in FIG. 4. It can be seen in doing so the top ridge 32 of the tail portion 37, which provided a fulcrum means in conventional pliers, rides around the outer circumference of the post 58 so that the point of contact of the tail portion 37, thus providing the fulcrum point for the outward pull of the staple, moves continuously to a less advantageous point leverage-wise. Therefore, the smaller the diameter of the post the more difficult it becomes to completely remove the staple 57 in a single smooth operation. It is not unusual that the purpose of removing the staple is to free the fencing strand 60 from a post which is broken off near the ground. In such a situation the turning of the plier in the direction of the arrow B simply causes the post to rotate about its own vertical axis with out applying any real pull of the staple in a direction parallel to the prongs of the staple.

With the present invention, on the other hand, once the staple has been gripped, as shown in FIG. 4, the handles of the plier are pushed downwardly as indicated by arrow B in FIG. 5, i.e., in a direction toward the side from which the fulcrum means 50 projects. This causes the top ridges 53, 53' which form post engaging surfaces of the laterally projecting fulcrum means 50 to engage the post 58 below the staple 57, and as the point of contact, i.e., the fulcrum point, moves down the post, good leverage is provided as the pincer points 46,47 pull outwardly in a direction remaining in the vertical place containing the staple 57 with only a small downward component by the time the staple has been completely withdrawn from the post 58. In the event the post is broken off near the ground, good leverage can be provided against significant movement of the post by blocking the lower end of the post from swinging outwardly. It may be appreciated that the orientation of the plier relative to the staple have been shown in FIGS. 4 and 5 as one example. Alternatively, the plier can be turned over before being brought into gripping engagement with the staple 57 so that the protuberance or fulcrum means 50 projects upwardly instead of downwardly as shown in the above example. Thus, in this alternative gripping position, the handles are swung upwardly within a substantially v vertical plane to withdraw the staple. This alternative may be preferable when the post is broken as it may be easier to prevent the bottom of the post from swinging inwardly and for the upper portion of the post swinging outwardly from the user while pulling upwardly on the plier. If the head portion 22 is provided with a laterally projecting protuberance on either side thereof, the plier can be swung either up or down once the staple has been grasped.

Referring now to the second embodiment of the invention as shown in FIGS. 6 to 11, the fencing plier 10*a* of this embodiment in the main has the same parts as the earlier described embodiment, including handle portions 15*a*, 17*a*, jaw portions 14*a*, 16*a*, head portion 22*a* defined between front and back faces, a hammer surface 35*a*, a tail portion 37*a*, and pincer points 46*a*, 47*a*. In this embodiment, the jaw portions 14*a*, 16*a* forming the head portion 22*a* are very similar in structure and shape to that previously described, and no further description in this regard is believed necessary. However, in addition to the jaw portion 14*a* having the hammer surface 35*a* similar to that of the first embodiment, and like those formed on conventional fencing pliers, the head portion 22*a* is provided with a supplementary hammer head portion 62 laterally projecting from a front face thereof.

Figure 11:
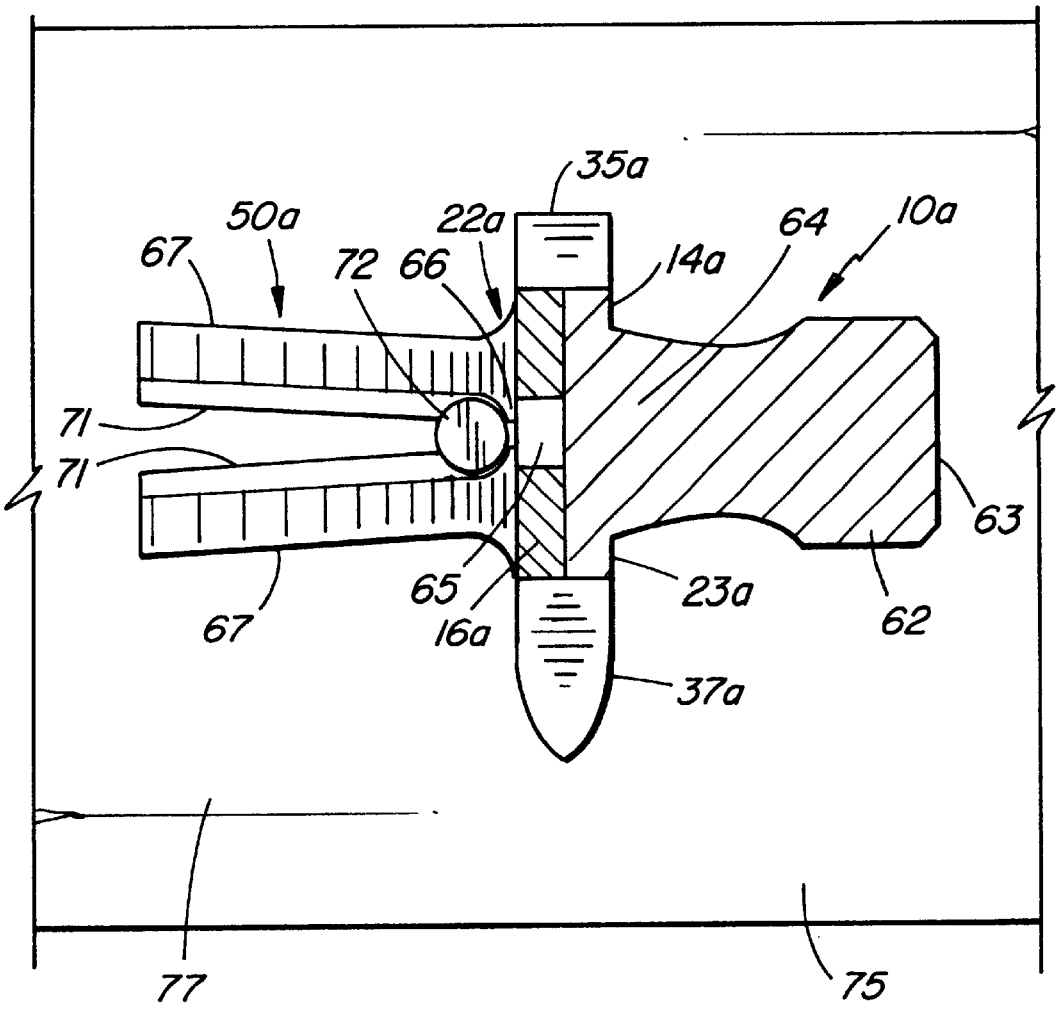
FIG. 11 is a cross sectional view as seen from the line 11—11 of FIG. 10.
Figure 12:
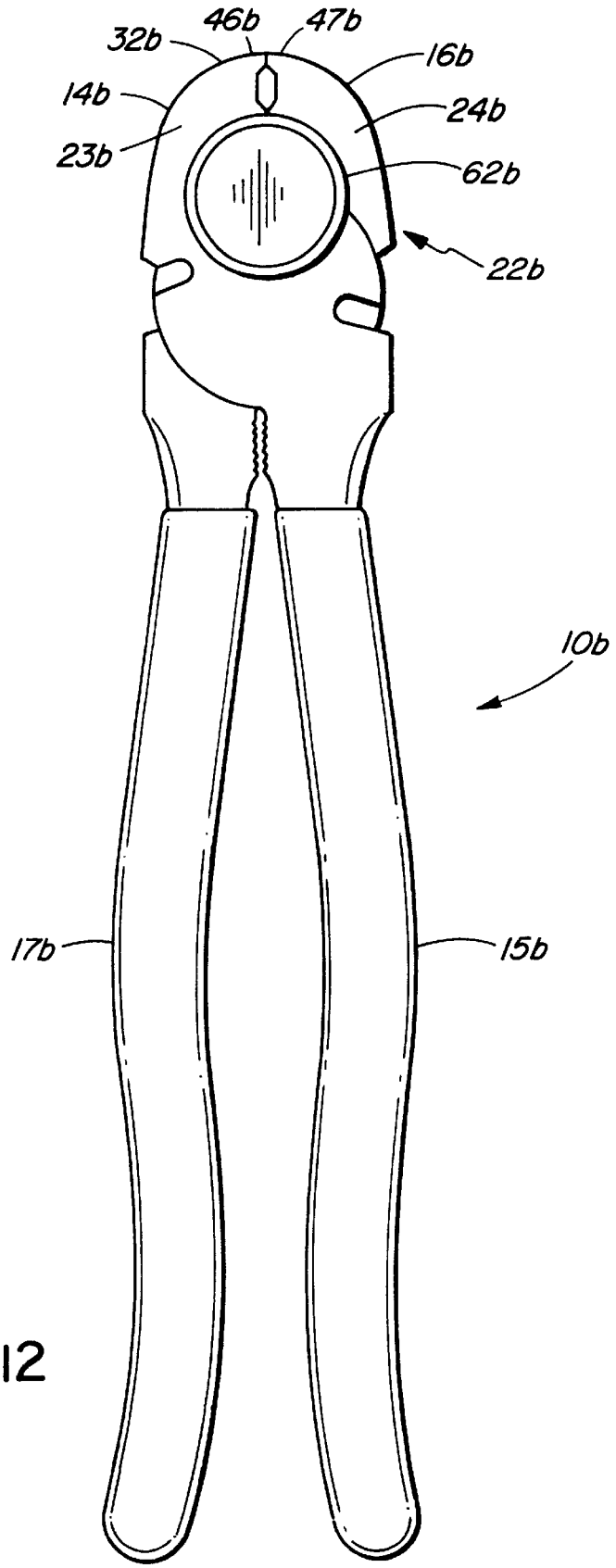
FIG. 12 is a view of a front face, corresponding to the face view of FIG. 7, but of a third embodiment of the fencing tool of the present invention.
Figure 13:
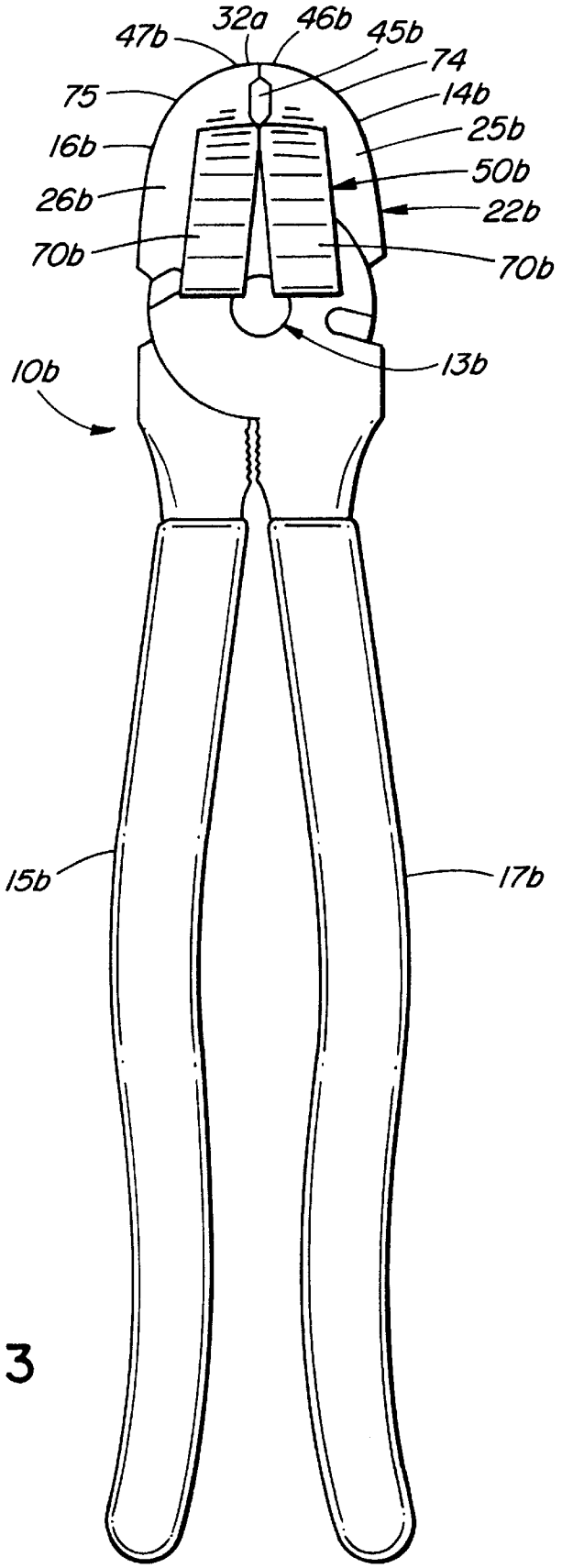
FIG. 13 is a view of the opposite or rear face of the third embodiment of the fencing tool shown in FIG. 12.
Figure 14:
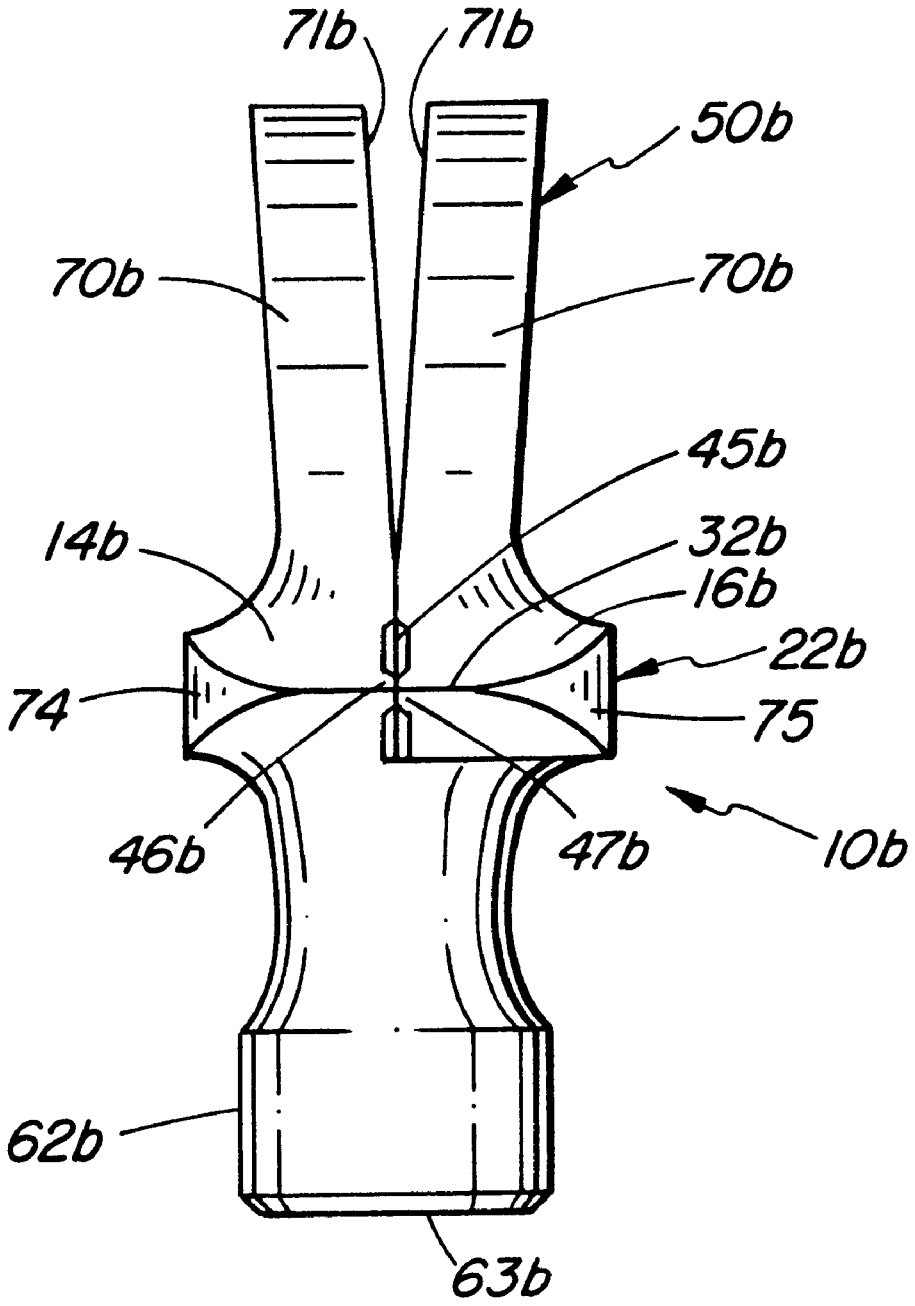
FIG. 14 is a top view, corresponding to that shown in FIG. 3 of FIG. 12, but showing the fencing tool of the third embodiment.

The supplementary hammer head 62 is shown as having the shape of the driving head of a conventional hammer, including a driving front surface 63 and a base portion 64 which may be formed integrally with the front face 23*a* of the jaw portion 14*a*. As best seen in FIG. 11, the jaw portion 14*a* has formed integrally therewith and extending rearwardly therefrom a stub shaft 65 which is received in an opening 66 in jaw portion 16*a*, thus providing pivot means 13*a* of the plier 10*a*. The hammer head 62 is coaxially disposed relative to the stub shaft 65 and projects forwardly from the front face 23*a* of the jaw portion 14.

It can be seen, therefore, that the plier 10*a* can be used to drive staples or nails using the surface 63 of the hammer head 62, and because the tool can be held with better balance while providing more momentum, straight driving is more easily achieved and larger nails can be driven more effectively. In fact because of the greater momentum provided by the greater weight due to the presence of the hammer head 62, more effective driving is achieved even when the surface 35*a* is used.

In the embodiment of the plier shown in FIGS. 6 to 11, the upper edges of the jaw portions 14*a*, 16*a* provide a top edge or ridge 32*a* which is continuous when the jaw portions 14*a*, 16*a* are closed and is shaped much like that of the embodiment of the invention of FIGS. 1 to 5. When closed, the pincer points 46*a*, 47*a* come together so as to encompass in the transverse opening 46*a* there below the bight of a staple 57 (not shown in FIGS. 6 to 11). However, instead of the fulcrum means 50*a* being of the shape utilized in the first embodiment, the laterally projecting members forming the fulcrum means 50*a* are in the form of a pair of closely spaced claws 67, 67 not unlike those of a conventional claw-type hammer.

Each claw 67, as seen from the side is somewhat similar in shape to the tail portion 51,51' in that they have an upper surface 70,70 which converges with the top ridge 32*a* and curves smoothly outwardly and downwardly away from the inner ends integrally formed with the back faces 23*a* and 24*a* of the jaw portions 14*a*, 16*a*. The claws 67, 67 have opposed grooved inside edges 71, 71, which converge towards the back faces 14*a*, 16*a*, in the manner of conventional hammer claws.

Figure 10:
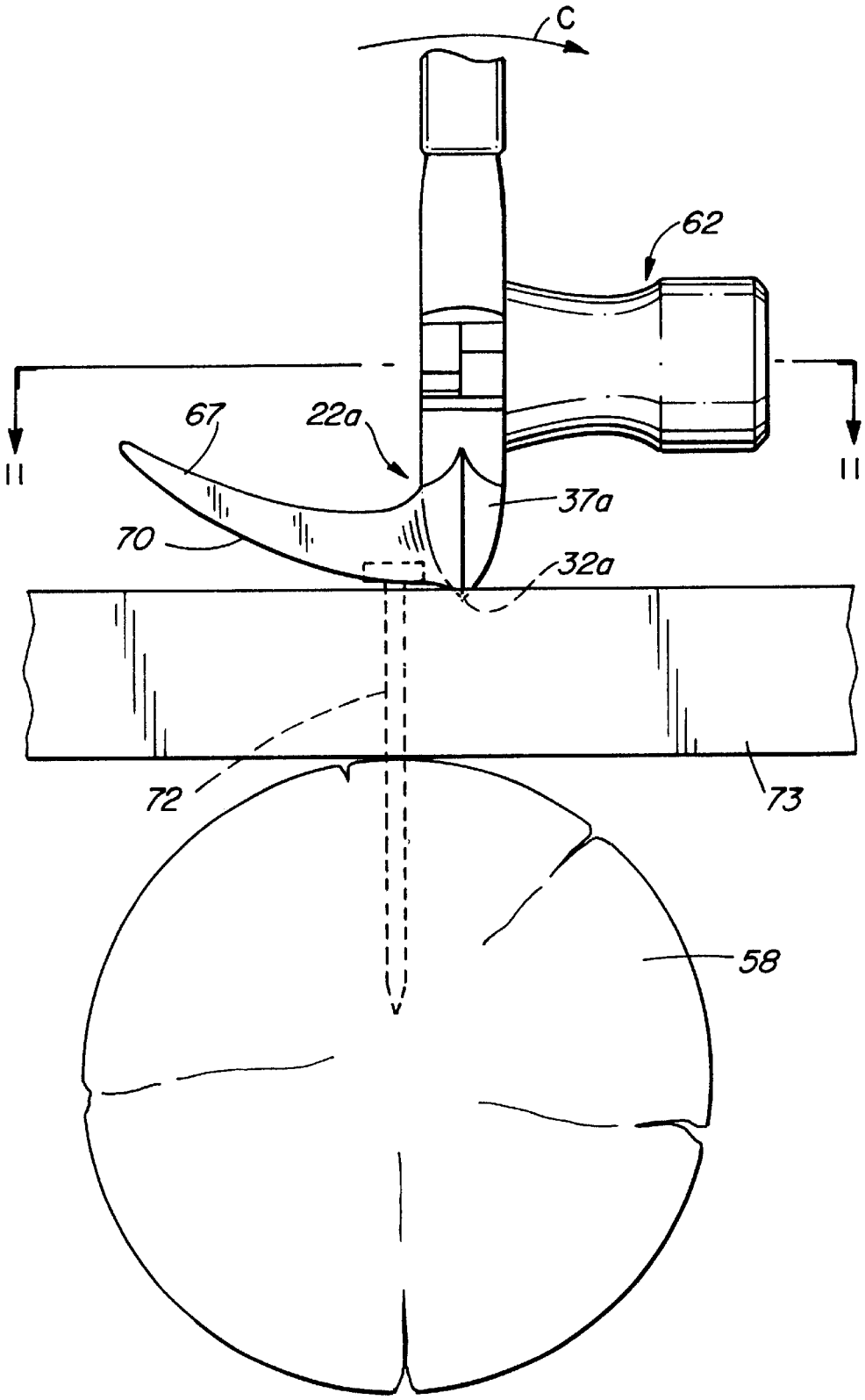
FIG. 10 is a partial side view opposite to that of FIG. 6 and showing the second embodiment of the present invention as being used to pull a spike from a plank nailed to a post.

The manner in which the fencing plier 10*a* may be used to withdraw a spike 72 is illustrated in FIGS. 10 and 11 wherein the spike 72 is shown as fastening a plank 73 to the post 58. With the handles 15*a*, 17*a* tightly grasped, the claws 67, 67 and the head of the spike 72 clamped in the V-shaped space between the claws, the handles are pulled in the direction indicated by the arrow C of FIG. 10 so that the tool is rocked about a fulcrum provided by the top ridge 32*a*, thus providing an upward force on the spike 72. It should be noted that with the particular structure provided by the plier 10*a*, the claws can be utilized with advantages not available with a conventional claw-type hammer. The two claws 67, 67 are each formed integrally with a separate one of the jaws 14*a*, 16*a*. Thus as the plier is opened by spreading the handles 15*a*, 17*a*, the claws 67, 67 are separated. Then, on tightly closing the handles, the inside edges 71, can be caused to wedge under a head of a tightly driven nail or spike. This action is enhanced by forming a sharp edge at the juncture of the inside edge 71 and the upper surface 70. Also because of the gripping action on the spike which can be achieved with the sharpened edges, the nail of the spike can be released by opening handles 15*a*, 17*a*, and then by rocking the plier back in a direction opposite to arrow C, the shank of the spike can be gripped again between the sharpened edges closer to the surface of the wood before again swinging the plier in the direction of the arrow C to pull a further length of the spike from the wood. Thus, the spike can be completely pulled without utilizing a block to lift the tool to a higher level as is a common practice when pulling a long nail with a conventional hammer.

When pulling a staple as in the situation illustrated for the previous embodiment, as illustrated in FIGS. 4 and 5, the bight of the staple 57 is grasped within the transverse opening 46*a* under the pincer points 46*a*, 47*a*. The tool is then rocked sideways so as to use the upper surfaces 70, 70, of the laterally extending claws 67,67 which thus functions as a moving fulcrum point in the same fashion as described in relation to the fulcrum means 50 of the first embodiment. Accordingly, the second embodiment as shown in FIGS. 6 to 11, has the same advantageous features and ability to extract staples from posts and the like and it has other features allowing more effective driving of nails, staples and the like and further allowing the withdrawing of driven nails and the like.

Referring now to the third embodiment of the invention in the form of the fencing tool 10*c* shown in FIGS. 12 to 15, this embodiment again has parts which correspond to some extent with those of the two previously described embodiments. Again, the plier 10*b* includes a pair of elongated members providing handles 15*b*, 17*b* and being pivotally connected in scissor fashion by a pivot means 13*b*. A head portion 22*b* is disposed on the opposite side of the pivot means 13*b* as the handles 15*b*, 17*b*. Like the second embodiment, the third embodiment includes a hammer head 62*b* projecting laterally from the front surface of the head defined by front faces 23*b* and 24*b* of jaw portions 14*b* and 16*b*, respectively. Of significance, however, while plier 10*b* has a top edge or ridge 32*b*, the jaw portions 14*b* and 16*b* do not include a portion providing a hammer surface corresponding to hammer surfaces 35 and 35*a* of the two previous embodiments, nor do they include a tail portion corresponding to the tail portions 37 and 37*a* of the two previous embodiments. Instead side edges 74 and 75 of jaw portions 14*b* and 16*b*, respectively, extend upwardly and curve smoothly inwardly to pincer points 46*b* and 47*b*, so that together, the top portions of side edges 74 and 75 form a substantially semi-circular shaped top ridge or outline 32*b* of the head portion. Provided below pincer points 46*b* and 47*b* is the transverse opening 45*b* which together with the pincer points 46*b* and 47*b* form the staple grasping means as in the case of the previously described embodiments.

Formed on and projecting lateral from the front face 23*b* of the jaw portion 14*b*, on an axis parallel to but vertically above the pivot means 13*b*, is a hammer head 62*b*. The hammer head 62*b* is therefore preferably located on a radial line extending substantially from the pivot axis of the pair of members 11 and 12 and through closed pincer points 46*b* and 47*b*. Like the supplementary hammer head 62*a* described in relation to the previous embodiment, the hammer head 62*b* has the shape of the head of a conventional hammer, having a driving surface 63*b*. The hammer head 62*b* has a base portion 64*b* which is preferably formed integrally with the jaw portion 14*b*.

The plier 10*b* is provided with a pair of claws 67*b*, 67*b*, on each jaw portions 14*b*, 16*b*, respectively, projecting laterally from the rear or back surfaces 25*b*, 26*b*, of the jaw portions. As is most apparent from FIGS. 13 and 14, when the handles of the plier are squeezed together to close the jaw portions 14*b*, 16*b*, opposed inside edges 71*b*, 71*b*, of the claws 67*b*, 67*b* have the same relation to each other as inside edges of claws on a conventional hammer. Thus, the claws of the plier 10*b* may be utilized for withdrawing nails or the like as described above in relation to the plier 10*a*.

The claws 67*b*, 67*b* also form in relation to the pincer point 46*b*, 47*b*, a fulcrum means 50*b*, the claws 67*b*, 67*b*, each being shaped with an outwardly and downwardly curved upper surface 70*b*. The top ridge 32*b* is disposed a short distance above the upper surfaces 70*b*, 70*b*, with the upper surface 70*b*, 70*b* at their inner ends adjacent the rear faces 25, 26, curving more abruptly upward and terminating at the top ridge 32*b*.

Figure 15:
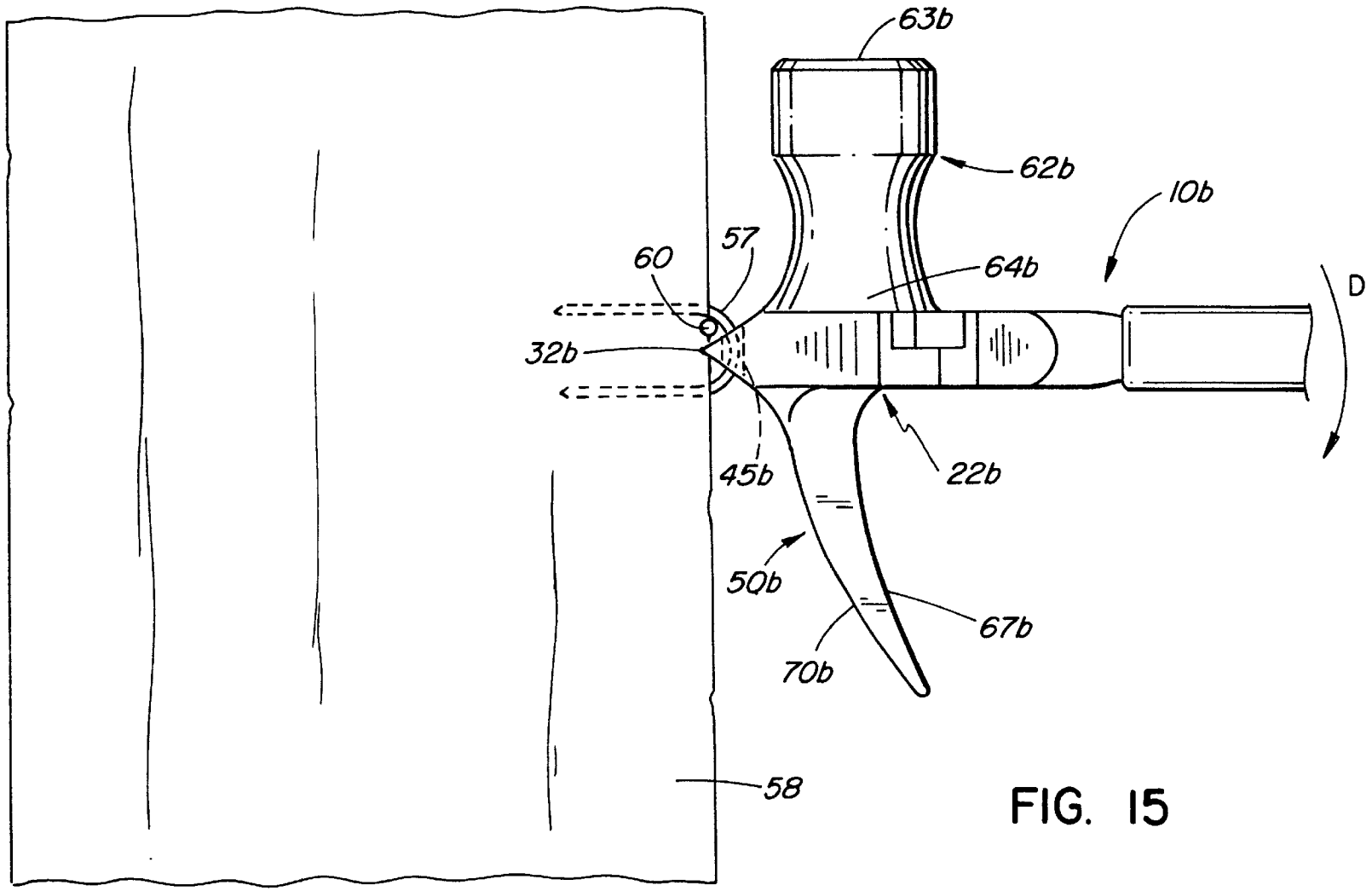
FIG. 15 is a side view corresponding to FIG. 5, but showing the fencing tool of the third embodiment of the invention.

When the pincer points 46*b*, 47*b*, are closed to capture the bight of a staple within the transverse opening 45*b*, such as in the case of a staple 57 oriented in a vertical plane to secure a horizontal fence strand 60, as illustrated in FIG. 15, the handles of the plier are then pushed downwardly in the direction of the arrow D. As the plier is pushed in the direction of the arrow, the upper surfaces 70*b*, 70*b* of the fulcrum means 50*b* come into engagement with the post 58 so as to provide a fulcrum point about which the head portion 22*b* pivots to pull the grasped staple from the post. During this action the point of contact providing the pivot point of the head portion moves vertically downward along the post.

Accordingly, the plier 10*b* has the same advantageous staple pulley features as the previously described embodiments of the present invention. Moreover, with the third embodiment, wherein the hammer head 62*a* is located above the pivot means, and in substantially the same relationship to the claws 67*b*, 67*b* of a normal hammer 1 as shown, the tool has been found to have better balance and feel when driving a staple or nail than with the arrangement shown in the second embodiment. It has been further found that with the functional characteristics of the tool shown in FIGS. 12 to 15, there may be little requirement for a hammer surface 35 and tail portion 37 as shown in relation to the first embodiment described above. Also the cleaner design of the embodiment of FIGS. 12 to 15 provides a less cumbersome tool to carry and use.

Moreover, it can be seen in the embodiments of FIGS. 6 to 15, and particularly in the embodiment of FIGS. 12 to 15, the hammer head 62 or 62*b* effectively provides a laterally projecting protuberance on the face of the head portion of the tool opposite to laterally projecting protuberances 50*a* or 50*b*. Looking at FIG. 15, for example, it can be seen that if the plier is swung in a direction opposite to the arrow D, i.e., upwardly instead of downwardly, should this be more convenient, the hammer head provides an effective fulcrum for withdrawing the staple as the plier is swung in a direction coinciding with the plane of the staple.

While three embodiments of the invention have been illustrated, various modifications within the spirit of the invention as defined in the appending claims will be apparent to those skilled in the art.

What I claim is:

1. A plier for pulling staples from posts and the like, the staples being of the type including a transverse bight portion joining a pair of spaced leg portions, said plier comprising:

a pair of members connected in scissor-fashion for pivotal operating action in a plane normal to a pivot axis of said members, said members each including a jaw and a handle portion, said jaws of said pair of members forming a head portion above said axis and opposite of said pivot axis to said handles portions, said head portion having opposite side faces formed by said jaws and disposed in substantially parallel planes normal to said axis, said jaws in a closed position defining a substantially continuous post engaging top edge, said jaws having opposed inner surfaces defining pincer points adjacent said top edge for movement toward engagement on closure of said handles to thereby grasp said bight of said staple thereunder;

said jaws having side edges curving smoothly upwardly and inwardly to said opposed inner surfaces of said jaws thereby forming said top edge in the form of continuous ridge in a plier closed condition, said continuous ridge being in the form of a substantially semi-circular top outline of said head portion, said plier including a fulcrum means formed integrally with said head portion and projecting laterally from one of said opposite side faces, said fulcrum means including a pair of fulcrum members, one each being integrally formed with one of said jaws on a common side face of said head portion, said fulcrum means defining upper edges extending in a plane substantially normal to said post engaging top edge of said jaws, so that on swinging movement of said handle portions in a plane normal to said top edge leverage is provided for pulling a staple grasped by said pincer points, and a single hammer head integrally formed with one of said jaws and projecting from the side face of said head portion opposite to said one of said opposite side faces of said head portion, said hammer head being disposed on an axis parallel to but disposed vertically above the pivot axis of the pair of connected members between said pivot axis and said pincer points.

2. A plier as defined in claim 1, wherein the upper edge of each fulcrum member curves outwardly and downwardly away from said top edge of said jaws towards an outer end of said fulcrum member, and wherein said fulcrum members have opposed inner edges forming a nail grasping opening diverging from said one of said opposite side surfaces of head portion, so as to thereby together form a hammer-claw configuration when said plier is in a closed condition and thus provide a tapered nail receiving opening by way of diverging, opposed inner edges of said fulcrum members.

3. A fastener pulling tool for withdrawing staples, nails and the like from articles such as wooden posts and planks, said tool being of the type having:

a pair of members connected in scissor-fashion for pivotal operating action in a plane normal to a pivot axis of said members, said members each including a jaw and a handle portion, said handles portions extending away from said pivot axis and terminating at a lower handle end of said tool, said jaws of said pair of members forming an upper head portion opposite of said pivot axis to said handle portions, said head portion having opposite side faces formed by said jaws and disposed in substantially parallel planes normal to said pivot axis, said jaws having opposed inner surfaces for movement toward each other on pivotal closure of said handle portions and defining fastener grasping pincer points adjacent a top ridge of said head portion, said tool including a fulcrum means formed integrally with said head portion and projecting in a lateral direction from one of said opposite side faces, said fulcrum means being formed by a pair of fulcrum members one each being integrally formed with one of said jaws on a common side face of said head portion and projecting in a substantially lateral direction from said common side, said pair of fulcrum members together having a hammer claw-like configuration defining a fastener grasping opening therebetween as said tool is moved to a closed condition, said jaws in said closed condition defining a substantially continuous top edge;

said fulcrum members curving outwardly from immediately below said top ridge and downwardly toward said handle end of said tool to thereby provide curving upper surfaces for engaging said article as said tool is rocked to withdraw said fastener from said article, and a hammer head formed integrally with one of said jaws and projecting outwardly from the side face of said head portion opposite to said one of said opposite side faces said hammer head having an axis parallel to the pivot axis of said pair of members and disposed above said pivot axis on a line extending between said pivot axis and said pincer points.

4. A tool as defined in claim 3, wherein said fulcrum members have opposed inner side edges forming said nail grasping opening therebetween, said inner side edges diverging from each other in a direction extending away from said one side face of said head portion.

* * * * *